US005447304A

United States Patent [19]

Vargas

[11] Patent Number: 5,447,304

[45] Date of Patent: Sep. 5, 1995

[54] REMOVABLE BASKETBALL NET ASSEMBLY

[76] Inventor: Florencio A. Vargas, 233 E. 3rd St., Apt. 5B, New York, N.Y. 10009

[21] Appl. No.: 151,910

[22] Filed: Nov. 15, 1993

[51] Int. Cl.[6] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 3,160,414 | 12/1964 | Gray | 273/1.5 A |
| 3,795,401 | 3/1974 | Voltz et al. | 273/1.5 A |
| 4,805,903 | 2/1989 | McArdle | 273/1.5 R |
| 4,887,812 | 12/1989 | Moormann | 273/1.5 R |
| 4,903,964 | 2/1990 | Anderson | 273/1.5 R |
| 4,905,995 | 3/1990 | Apo | 273/1.5 R |
| 5,098,091 | 3/1992 | McGivern | 273/1.5 R |
| 5,123,642 | 6/1992 | Stokes | 273/1.5 R |

*Primary Examiner*—Paul E. Shapiro

*Attorney, Agent, or Firm*—David L. Baker; Rhodes & Ascolillo

[57] ABSTRACT

A removable basketball net assembly for installation on a fixed basketball hoop, the assembly having a circular, downwardly-open overlay ring for placement on an upper surface of the basketball hoop and a plurality of first and second types of clips. The assembly minimizes the reduction of the inside diameter of the hoop. The overlay ring has a generally semi-circular in-cross-section shell portion which has an inner surface that abuts the hoop. Each type of clip has a downwardly-open arcuate shape, a top side being complementary to the inner surface of the shell portion and a bottom side being complementary to the upper surface of the hoop. The overlay ring grips the hoop with a plurality of the first type of clips which are attached to the inner surface of the shell portion. Lower ends of the first type of clips extend below a horizontal centerline of the hoop, such that the lower ends will elastically deform outwardly as the overlay ring is placed on the hoop and will then spring back to grip the hoop and hold the overlay ring removably in place. A basketball net may be attached to the overlay ring by a plurality of the second type of clips which are attached to the inner surface of the shell portion, each of the second type of clips having a hook which depends from an inner side of the clip, to which the net may be attached

9 Claims, 1 Drawing Sheet

80
20
50
62
64
5
70
7
30
34
60
22
6
40
32

REMOVABLE BASKETBALL NET ASSEMBLY

BACKGROUND OF THE INVENTION

1. Field of the Invention.

The present invention relates to the game of basketball generally and, more particularly, but not by way of limitation, to a novel basketball net that is easily and quickly installed on, and removed from, a fixed basketball hoop.

2. Background Art.

The well known game of basketball is played on a court with at least one elevated horizontal hoop mounted to a backboard at one end of the court. The hoop is circular with an inside diameter of 18 inches. Usually, a net is attached to and depends from the perimeter of the hoop. The presence of the net gives a satisfying "swish" sound as a basketball passes through the hoop and net and, also, the presence of the net decreases the ball's velocity and, therefore, the distance the ball will travel from the court once a ball passes through the net.

Unfortunately, basketball courts on outdoor playgrounds frequently have hoops without nets. This scenario is extremely commonplace in large cities and many other places as well. Often, the hoops do not even have hooks on which to secure a net.

There have been some attempts to provide removable basketball nets:

U.S. Pat. No. 4,887,812, issued Dec. 19, 1989, to Moormann, describes a basketball hoop with a net attached thereto, the hoop being insertable in a bracket placed over the upper edge of a door or other elevated structure.

U.S. Pat. No. 4,905,995, issued Mar. 6, 1990, to Apo, describes a basketball net assembly having an annular collar to which a basketball net is attached. The collar has an outwardly facing flange at the top thereof so that the collar may be supported inside the opening of a fixed basketball hoop by the flange engaging the upper surface of the hoop. The arrangement substantially decreases the regulation 18-inch inside diameter of the hoop.

U.S. Pat. No. 5,098,091, issued Mar. 24, 1992, to McGivern, describes a basketball net support which comprises a twisted wire rod which is bendable into the shape of a basketball hoop and the ends of the rod then attached together. Snap-together fastening straps support the rod below a basketball hoop. The net depends from the rod.

U.S. Pat. No. 5,123,642, issued Jun. 23, 1992, to Stokes, describes a net attachment system for a basketball hoop which includes a circular ring to which the basketball net is attached. The ring is supported below the hoop by means of hooks which extend upwardly from the ring and over the hoop.

The above net installation systems variously suffer from the disadvantages of complexity and/or substantially decreasing the inside diameter of a basketball hoop.

Accordingly, it is a principal object of the present invention to provide a net assembly for a basketball hoop that can be easily and quickly installed on, and removed from, a basketball hoop.

It is a further object of the invention to provide such a net assembly that is rugged.

It is an additional object of the invention to provide such a net assembly that is economically manufactured.

It is another object of the invention to provide such a net assembly that does not substantially decrease the inside diameter of a basketball hoop.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a removable basketball net assembly for installation on a fixed basketball hoop, said assembly comprising: an overlay ring to be placed on an upper surface of said basketball hoop, an attaching means to attach a basketball net to said overlay ring, and a gripping means to permit said overlay ring to releasably grip said basketball hoop as said overlay ring is placed on said upper surface of said basketball hoop.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figures 1, 2, 3, 4, 5, 6, 7, 8:
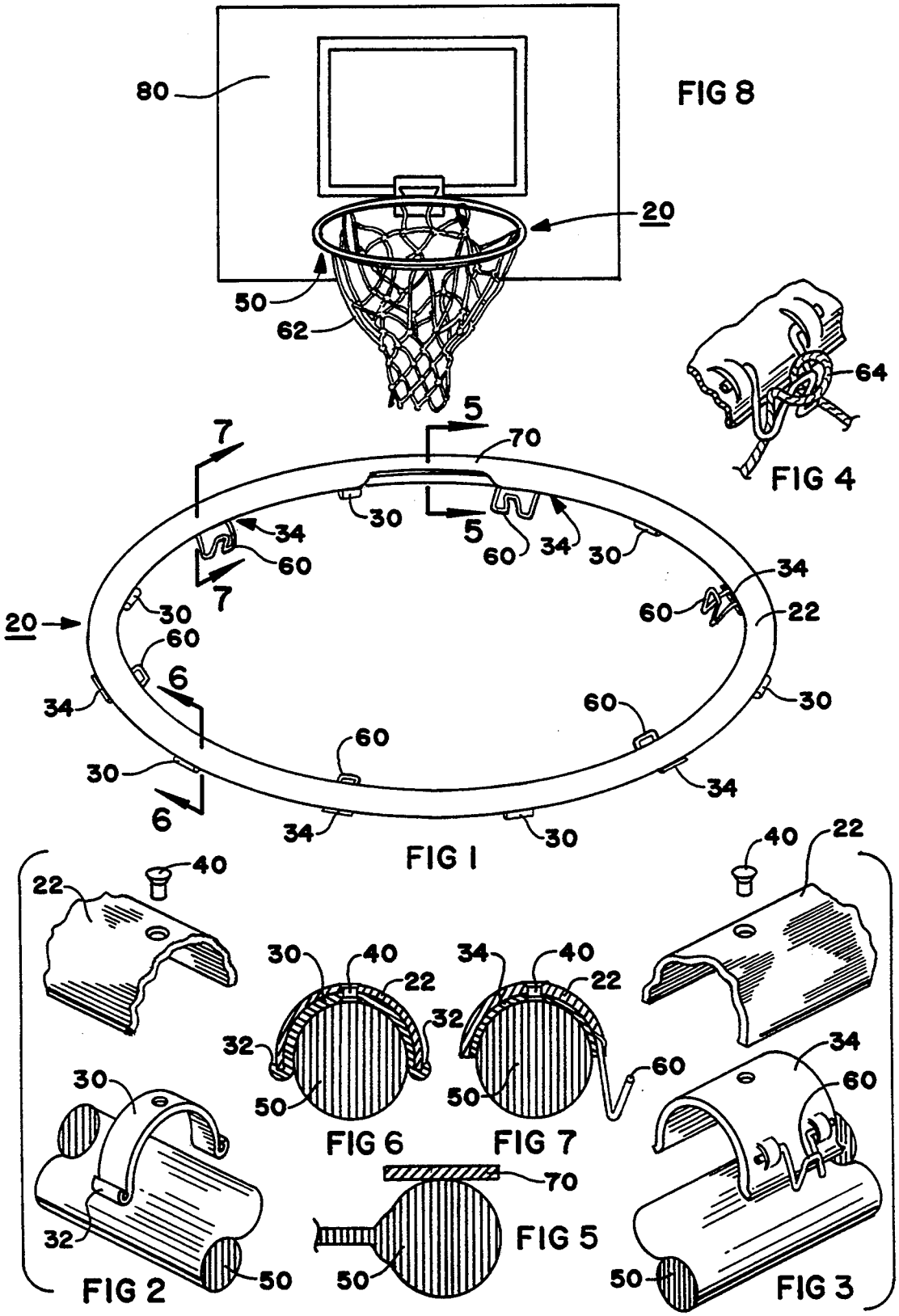
FIG. 1 is a isometric view of a basketball hoop overlay ring (without a net) according to the present invention.
FIG. 2 is a fragmentary, exploded, isometric view, partially in cross-section, illustrating one type of clip for fastening the overlay ring of FIG. 1 to a basketball hoop.
FIG. 3 is a fragmentary isometric view, partially in cross-section, illustrating another type of clip for fastening a basketball net to the overlay ring of FIG. 1.
FIG. 4 is a fragmentary isometric view, partially in cross-section, of the clip of FIG. 3 showing the method of attachment thereto of a basketball net.
FIG. 5 is a fragmentary, side elevational view, in cross-section, taken along line "5—5" of FIG. 1.
FIG. 6 is a side elevational view, in cross-section, taken along line "6—6" of FIG. 1.
FIG. 7 is a side elevational view, in cross-section, taken along line "7–7" of FIG. 1.
FIG. 8 is an isometric view of the net assembly of the present invention installed on a basketball hoop.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a basketball hoop overlay ring, generally indicated by the reference numeral 20. Overlay ring 20 includes a continuous, circular, downwardly open, and generally semi-circular-in-cross-section shell portion 22 (also FIGS. 2 and 3).

Attached to the inner surface of shell portion 22 are a first type of clips 30 (FIGS. 1, 2, and 6), each of the first type of clips being of downwardly open arcuate shape the top side of the clip being complementary to that of the inner surface of the shell portion 22 and the bottom side of the clip being complementary to that of the upper surface of a basketball hoop 50. At the lower ends of clips 30 are upwardly turned flanges 32 which receive and grip the lower edges of shell portion 22 in order to add strength, durability and elasticity to said clips. Also attached to the inner surface of shell portion 22 are a second type of clips 34 (FIGS. 1, 3, and 7), each of the second type of clips being of downwardly open arcuate shape the top side of the clip being complementary to that of the inner surface of the shell portion and the bottom side of the clip being complementary to that of the upper surface of hoop 50. Clips 30 and 34 are attached to shell portion 22 by means of rivets 40.

Referring primarily now to FIG. 6, it can be seen that clips 30 extend below the horizontal centerline of basketball hoop 50 when attached thereto. So arranged, the ends of clips 30 will elastically deform outwardly as basketball hoop overlay ring 20 is placed on hoop 50 and then will spring back so as to grip the hoop 50 and hold the overlay ring 20 removably in place.

Referring primarily now to FIGS. 3 and 7, clips 34 include hooks 60 depending from the inner side of clips 34 to which a basketball net 62 (FIG. 8) may be attached by means of a suitable knot 64, as shown on FIG. 4.

Referring now to FIG. 5, it can be seen that shell portion 22 includes a flat portion 70 at the rear thereof, the flat portion being provided so that basketball hoop overlay 20 does not interfere with the means of attachment of hoop 50 to a basketball backboard 80 (FIG. 8).

FIG. 8 illustrates basketball hoop overlay 20 installed on hoop 50 which is attached to backboard 80.

It will be appreciated that the present invention is easily and quickly installed and removed and does not substantially decrease the inside diameter of hoop 50.

Materials of manufacture may be any suitable materials and preferably will be a non-rusting, strong, lightweight polymeric material, with shell portion 22 being formed by conventional injection molding techniques.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A removable basketball net assembly for installation on a fixed basketball hoop, said assembly comprising:

(a) a circular and downwardly open overlay ring to be placed on an upper surface of said basketball hoop;

(b) said overlay ring comprising a generally semi-circular-in-cross-section shell portion, such that an inner surface of said shell portion is in proximity to said upper surface of said basketball hoop when said overlay ring is placed on said basketball hoop;

(c) an attaching means to attach a basketball net to said overlay ring; and (d) a gripping means to permit said overlay ring to releasably grip said basketball hoop as said overlay ring is placed on said upper surface of said basketball hoop, said gripping means comprising:

a plurality of first downwardly-open arcuate shaped clips attached to said inner surface of said shell portion;

a lower end of said plurality first downwardly-open arcuate shaped clips extending below a horizontal centerline of said basketball hoop; and said lower ends of said plurality of first downwardly-open arcuate shaped clips being elastically deformable outwardly as said overlay ring is placed on said basketball hoop and springingly returnable to a pre-deformable shape to grip said hoop and hold said overlay ring removably in place.

2. A removable basketball net assembly, as defined in claim 1, wherein each of said plurality of first downwardly-open arcuate shaped clips are fixedly attached to said shell portion by rivets.

3. A removable basketball net assembly, as defined in claim 1 further comprising:

(a) a backboard attaching means to attach said fixed basketball hoop to a basketball backboard; and (b) said overlay ring further comprising a flat shell portion positioned on top of the backboard attaching means.

4. A removable basketball net assembly, as defined in claim 9, wherein each of said plurality of first downwardly-open arcuate shaped clips further comprise upwardly turned flanges disposed at each of said lower ends of said plurality of first downwardly-open arcuate shaped clips.

5. A removable basketball net assembly for installation on a fixed basketball hoop, said assembly comprising:

(a) a circular and downwardly open overlay ring to be placed on an upper surface of said basketball hoop;

(b) said overlay ring comprising a generally semi-circular-in-cross-section shell portion, such that an inner surface of said shell portion is in proximity to said upper surface of said basketball hoop when said overlay ring is placed on said basketball hoop;

(c) an attaching means to attach a basketball net to said overlay ring;

(d) said attaching means comprising:

a plurality of a second downwardly-open arcuate shaped clips attached to said inner surface of said shell portion a top side of said plurality of second downwardly-open arcuate shaped clips being complementary to that said inner surface of said shell portion and the bottom side of said clips being complementary to that of said upper surface of said basketball hoop;

said plurality of second downwardly-open arcuate shaped clips including hooks attached to and depending from an inner side of the clips to which a basketball net may be attached; and (e) a gripping means to permit said overlay ring to releasably grip said basketball hoop as said overlay ring is placed on said upper surface of said basketball hoop.

6. A removable basketball net assembly, as defined in claim 5, wherein each of said plurality of second downwardly-open arcuate shaped clips are attached to said shell portion by rivets.

7. A removable basketball net assembly, as defined in claim 5, further comprising:

(a) a backboard attaching means for fixedly attaching the basketball hoop to a basketball backboard; and (b) said overlay ring further comprising a flat shell portion positioned on top of the backboard attaching means.

8. A removable basketball net assembly for installation on a fixed basketball hoop, said assembly comprising:

(a) a circular and downwardly open overlay ring to be placed on an upper surface of said basketball hoop, said overlay ring having a generally semi-circular-in-cross-section shell portion, such that an inner surface of said shell portion is in proximity to said upper surface of said basketball hoop when said overlay ring is placed on said basketball hoop;

(b) a gripping means to permit said overlay ring to releasably grip said basketball hoop as said overlay ring is placed on said upper surface of said basketball hoop; and (c) said gripping means comprising:

a plurality of first downwardly-open arcuate shaped clips:

said plurality of first downwardly-open arcuate shaped clips attached to said inner surface of said shell portion;

the top side of said plurality of first downwardly-open arcuate shaped clips being complementary to that of said inner surface of said shell portion and a bottom side of said plurality of first downwardly-open arcuate shaped clips being complementary to that of said upper surface of said basketball hoop;

a lower end of said plurality of first downwardly-open arcuate shaped clips extending below a horizontal centerline of said basketball hoop;

said lower ends of said plurality of first downwardly-open arcuate shaped clips being elastically deformed outwardly as said overlay ring is placed on said basketball hoop and springingly returnable to a pre-deformable shape to grip said hoop and hold said overlay ring removably in place;

each of said plurality of first downwardly-open arcuate shaped clips comprising upwardly turned flanges disposed at each of said lower ends of said plurality of first downwardly-open arcuate shaped clips; and each of said plurality of first downwardly-open arcuate shaped clips are fixedly attached to said shell portion by rivets;

(d) an attaching means to attach a basketball net to said overlay ring;

(e) said attaching means comprising:

a plurality of second downwardly-open arcuate shaped clips attached to said inner surface of said shell portion;

a top side of said plurality of second downwardly-open arcuate shaped clips being complementary to that of said inner surface of said shell portion and a bottom side of said clips being complementary to that of said upper surface of said basketball hoop;

said second downwardly-open arcuate shaped clips comprising hooks depending from an inner side of said plurality of second downwardly-open arcuate shaped clips to which a basketball net may be attached; and each of said plurality of second downwardly-open arcuate shaped clips being attached to said shell portion by rivets.

9. A removable basketball net assembly, as defined in claim 8, further comprising:

(a) a backboard attaching means to attach said fixed basketball hoop to a basketball backboard; and (b) said overlay ring further comprising a flat shell portion positioned on top of the backboard attaching means.

* * * * *